United States Patent [19]

Holloway

[11] 4,065,952

[45] Jan. 3, 1978

[54] PULL THROUGH BLIND RIVETING TOOL

[75] Inventor: David John Holloway, Aldridge, England

[73] Assignee: USM Corporation, Boston, Mass.

[21] Appl. No.: 768,178

[22] Filed: Feb. 14, 1977

[51] Int. Cl.[2] ..... B21J 15/34

[52] U.S. Cl. ..... 72/391; 72/453.17

[58] Field of Search ..... 72/391, 453.17; 29/243.53

[56] References Cited

U.S. PATENT DOCUMENTS

| | | | |
|---|---|---|---|
| 2,570,801 | 10/1951 | Hamlin | 72/391 |
| 3,254,522 | 6/1966 | Elliott | 72/391 |
| 3,557,597 | 1/1971 | Heslop | 72/391 |

FOREIGN PATENT DOCUMENTS

| | | | |
|---|---|---|---|
| 2,225,441 | 2/1973 | Germany | 72/391 |
| 578,104 | 6/1946 | United Kingdom | 72/391 |
| 1,397,544 | 6/1975 | United Kingdom | 72/391 |

*Primary Examiner*—C.W. Lanham
*Assistant Examiner*—Gene P. Crosby
*Attorney, Agent, or Firm*—Carl E. Johnson; Richard B. Megley; Vincent A. White

[57] ABSTRACT

A blind riveting tool of the type including a reuseable mandrel carrying a plurality of rivets to be successively set thereby. The rivets are advanced along the mandrel by causing air to flow through a sleeve to urge a leading one of the rivets beyond abutment members at the end of the tool. A catch having a finger is provided for urging the next to leading rivet and those behind it rearwardly so that the abutment members can close to embrace the mandrel behind the leading rivet without interference from the next one. The arrangement also facilitates reloading of the tool with another or the same reuseable mandrel when a new group of rivets is to be installed.

8 Claims, 4 Drawing Figures

PULL THROUGH BLIND RIVETING TOOL

CROSS REFERENCES TO RELATED APPLICATIONS

A blind rivet and novel method for setting it by means of a reuseable mandrel are disclosed in Application Ser. No. 700,909, filed June 29, 1976, now U.S. Pat. No. 4,044,591 in the name of John Powderley.

A blind riveting tool having a reuseable mandrel and wherein a nosepiece assembly is pivotally mounted is disclosed in Application Ser. No. 725,530, filed Sept. 22, 1976.

BACKGROUND OF THE INVENTION

This invention is concerned with improvements in or relating to blind riveting and is especially concerned with tools for use in setting rivets in pull-through blind riveting.

The expression "pull-through blind riveting" is used herein to denote a procedure in which a shank of a tubular rivet having a head at one end, assembled on a stem of a mandrel which has a head which is too large to pass through the rivet shank without deforming it, is inserted in a hole in a workpiece from one side, in such a manner that the rivet head abuts the workpiece at said one side and the shank projects from the workpiece at the other side, and the rivet is set by pulling the mandrel stem at said one side of the workpiece while holding the head of the rivet against the workpiece whereby the mandrel head effects radial expansion of the rivet shank at the other side of the workpiece and is thereafter pulled right through the rivet.

It is customary in pull-through blind riveting to use a rivet-setting tool which has a nosepiece which serves as an abutment to engage the rivet head, and a mandrel with a long stem on which a number, for example 25, rivets are assembled, the rivets being set one after another upon reciprocation of the mandrel and forward feeding of the rivets successively through the nosepiece and up to the mandrel head. After all the rivets on the mandrel have been set, the mandrel is removed from the tool and the same, or another, mandrel loaded with fresh rivets is inserted in the tool.

To enable the rivets to pass forwardly along the mandrel stem through the nosepiece of a tool as just referred to, the nosepiece is constituted by two abutment members which separate, one on each side of a plane which includes the axis of the mandrel stem, thus allowing each rivet in turn to pass between the two members. In some pull-through blind riveting operations the members of the nosepiece close into abutting engagement with one another after a rivet has passed between them, the shape of the members and of the rivets permitting them so to do; in others, the members do not abut one another but close into engagement with the shank of the next following rivet on the mandrel stem. In some blind riveting operations, sufficient engagement with the rivet head in blind riveting is afforded by nosepiece members which engage only a peripheral margin of the rivet head, so far as permitted, if the members are surrounding the shank of the next rivet; in others it is important that the members closely surround the mandrel stem (as, for example, when carrying out blind riveting as described in the above-cited U.S. Patent Application Ser. No. 700,909).

It is also desirable that the mandrels of pull-through blind riveting tools can be rapidly changed when the supply of rivets on a mandrel has run out.

It is necessary for rivet-advancing means to be provided in a pull-through blind-riveting tool of the kind which has a mandrel with a number of rivets on its stem for feeding the rivets forwardly along the stem between riveting operations. Such means has customarily involved a stop device mounted on the mandrel stem and arranged to advance step by step therealong, a spring being interposed between the stop and the rearmost rivet. Such means has to be dismantled after all the rivets on a mandrel have been used to enable a fresh supply to be loaded onto it.

SUMMARY OF THE INVENTION

It is one of the various objects of the present invention to provide an improved tool suitable for use in pull-through blind riveting where it is important that the nosepiece which abuts the rivet head also closely surrounds the mandrel stem.

It is another of the various objects of the present invention to provide an improved pull-through blind riveting tool which permits rapid changing of long-stemmed mandrels on which many rivets are simultaneously loaded.

It is yet another of the various objects of the present invention to provide a pull-through blind riveting with improved means for causing the rivets to be advanced along the mandrel stem while in the tool.

There is hereinafter described in detail to illustrate the invention by way of example a pull-through blind riveting tool of the kind which is adapted for use with long mandrels having a column of say, 25 or more rivets on them. This illustrative tool comprises a housing having an elongated barrel on a front end portion of which a nosepiece is mounted, constituted by two abutment members pivotable between a closed condition in which they can engage a rivet head in a rivet-setting operation (and into which they are urged by spring means) and an open condition in which a rivet can be advanced between them along a mandrel stem. A catch, mounted on a common pivot with one of the abutment members, has a finger slidable in a slot in said one of the members so that, when swung against the action of spring means, it can engage the underside of the head of the rivet next to the leading one on the mandrel stem and push that rivet and those behind it rearwardly so that the abutment members can assume their closed condition behind the head of the leading rivet without interference from the shank of the next one.

The illustrative tool also comprises mandrel-engaging means in the form of a jaw case with a plurality of jaws mounted in it for sliding movement along paths inclined at a small angle to the axis of the barrel, a spring-pressed plunger urging the jaws forwardly of the jaw case into engagement with a mandrel stem. A sleeve extends axially within the barrel of the illustrative tool and surrounds the rivets carried by a mandrel. The sleeve is movable axially within the barrel and is arranged, on rearward movement, to engage said jaws and cause them to separate as they retract in the jaw case. Such rearward movement of said sleeve of the illustrative tool is arranged to take place upon opening of the abutment members more widely than occurs when they open to allow the leading rivet to pass between them, and such wider opening is caused to take place by engagement of arms of the abutment members with internal shoulder portions of a release member in the form of a collar slidable on a forward end portion of the barrel of the tool. Rearward movement of the collar manually by the operator thus opens both the abutment members of the nosepiece and the jaws of the mandrel-engaging means, permitting removal and replacement of a mandrel.

The aforementioned collar of the illustrative tool may also be arranged on forward movement of the barrel to operate the catch which pushes back the rivets on the mandrel stem.

Means of the illustrative tool for causing rivets to advance along a mandrel stem includes the aforementioned sleeve which surrounds the rivet heads on the mandrel stem, and an inlet, whereby a current of air is caused to flow forwardly through the sleeve. The rivets on the mandrel are thus caused by the air flow to advance towards the mandrel head, sufficient force being exerted by the leading one of them on the abutment members to overcome the influence of the spring means by which the abutment members are urged into their closed condition. To ensure such force shall be adequate, it is desirable that the sleeve closely surrounds the rivet heads. To avoid changing sleeves where the tool is used for rivets of varying head size, the rearmost rivet may be of uniform maximum head diameter on all mandrels, or the rivets can be backed up by a suitable plunger.

The illustrative tool enables pull-through blind riveting to be carried out reliably under circumstances where it is essential that the abutment members of the nosepiece closely embrace the mandrel stem behind the head of the leading rivet, and permits mandrels to be changed rapidly and re-charged without dismantling a complex rivet-advancing device.

The invention provides, in one of its several aspects, a blind-riveting tool comprising a housing which includes an elongated barrel, abutment members mounted on a front end portion of the barrel for movement between closed and open conditions and being engageable in their closed condition with a rivet head in a rivet-setting operation, means for engaging the stem of a mandrel with a plurality of rivets on it and arranged to pull the mandrel in a rivet-setting operation, means for causing the rivets to advance along the mandrel stem so that the leading rivet is advanced beyond said members, and means for engaging a front side of the head of the rivet next to the leading one and pushing that next rivet and those behind it rearwardly so that the abutment members can assume their closed condition behind the head of the leading rivet without interference from the shank of the next one.

The invention provides, in another of its several aspects, a blind-riveting tool comprising a housing which includes an elongated barrel, abutment members mounted on a front end portion of the barrel for movement between closed and open conditions and being engageable in their closed condition with a rivet head in a rivet-setting operation, means for engaging the stem of a mandrel with a plurality of rivets on it and arranged to pull the mandrel in a rivet-setting operation, and means mounted on the housing which both causes the abutment members to open and the mandrel-engaging means to release the mandrel stem, so that the mandrel may readily be removed from the tool and replaced.

The invention provides, in another of its several aspects, a blind-riveting tool comprising a housing which includes an elongated barrel, abutment members mounted on a front end portion of the barrel for movement between closed and open conditions and being engageable in their closed condition with a rivet head in a rivet-setting operation, means for engaging the stem of a mandrel with a plurality of rivets on it and arranged to pull the mandrel in a rivet-setting operation, and means responsive to opening of the abutment members more widely than occurs for allowing the rivets to advance therebetween in the operation of the tool for releasing the mandrel-engaging means, so that the mandrel may readily be removed from the tool and replaced.

The invention provides, in another of its several aspects, a blind-riveting tool comprising a housing which includes an elongated barrel, abutment members mounted on a front end portion of the barrel for movement between closed and open conditions and being engageable in their closed condition with a rivet head in a rivet-setting operation, means for engaging the stem of a mandrel with a plurality of rivets on it and arranged to pull the mandrel in a rivet-setting operation, a sleeve extending axially within the barrel and surrounding the rivets carried by a mandrel in the operation of the tool, and means for causing air to flow forwardly through the sleeve to advance the rivets along the mandrel stem so that the leading rivet can advance beyond said abutment members.

The invention provides, in another of its several aspects, a blind riveting tool comprising a housing which includes an elongated barrel, abutment members mounted on a front end portion of the barrel for movement between closed and open conditions and being engageable in the closed condition with a rivet head in a rivet-setting operation, means for engaging the stem of a mandrel with a plurality of rivets on it and arranged to pull the mandrel in a rivet-setting operation, a sleeve extending axially within the barrel and surrounding the rivets carried by a mandrel in the operation of the tool, the mandrel-engaging means comprising a plurality of gripping jaws mounted in a jaw case for sliding movement along paths inclined at a small angle to the axis of the barrel and urged into engagement with a mandrel stem by a spring-pressed jaw pusher, said sleeve being mounted for axial movement within the barrel of the housing and arranged, upon rearward movement, to engage said jaws and cause them to separate as they retract in said jaw case, the tool also comprising a manually operable release member mounted on the housing and arranged, upon actuation by the operator, to move said sleeve rearwardly to retract the jaws of the mandrel-engaging means and thus release the mandrel.

BRIEF DESCRIPTION OF THE DRAWINGS

The above and other of the various objects and several aspects of the invention will become more clear from the following description, to be read with reference to the accompanying drawings, of an illustrative tool. It will be realized that this illustrative tool has been selected for description by way of example and not of limitation of the invention.

In the accompanying drawings.

DESCRIPTION OF THE PREFERRED EMBODIMENT

Figure 1:
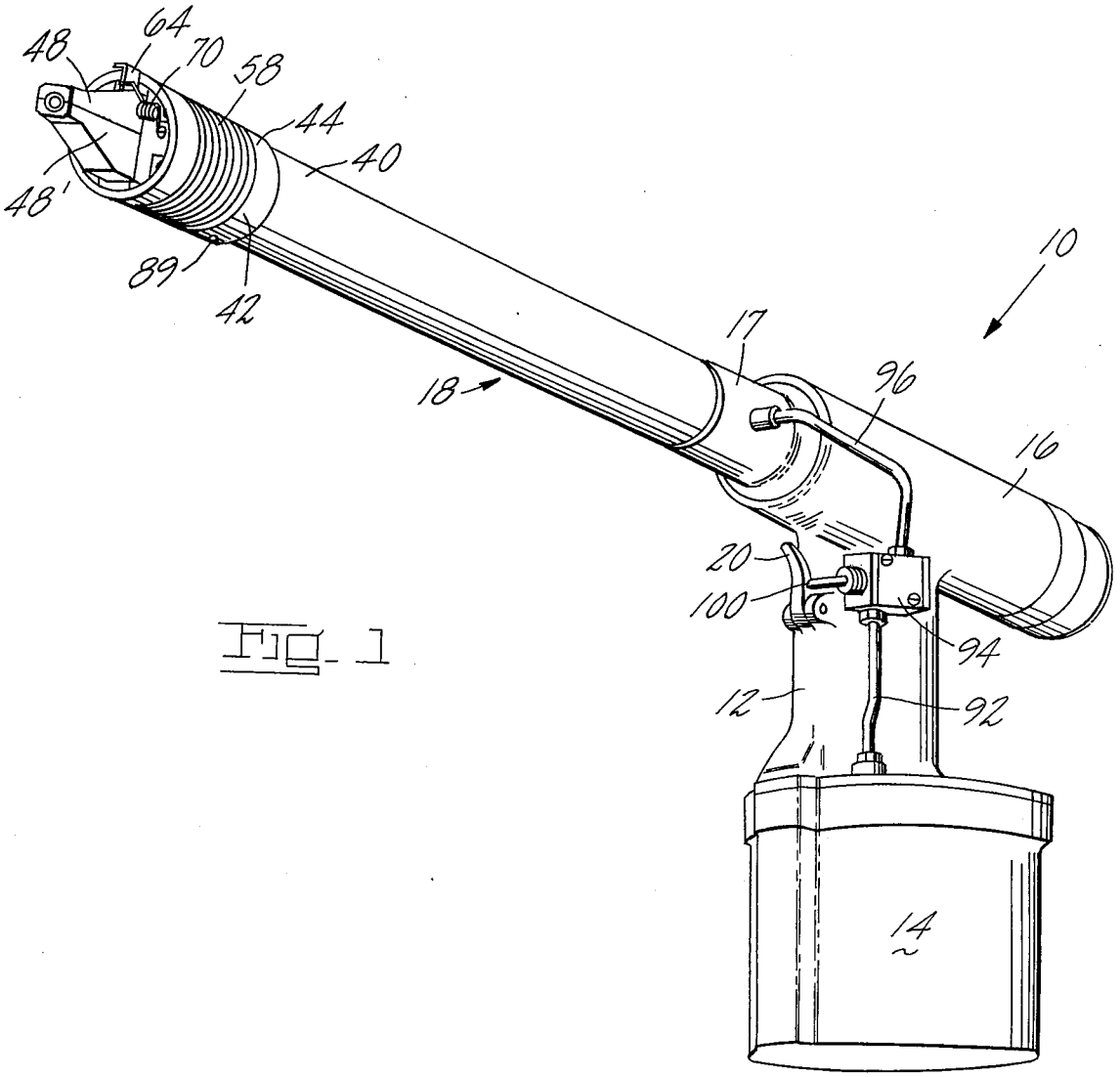
FIG. 1 is a view in perspective of the illustrative tool, without a mandrel in it.

The illustrative tool comprises a housing 10 which includes a hand grip portion 12, a pneumatic cylinder 14, a hydraulic cylinder 16, an intermediate portion 17, and an elongated barrel 18. The fluid pressure operated means and associated mechanism accommodated in the parts 12, 14, and 16 and 17 is of conventional construction and operation for a pneumatic/hydraulic blind-riveting tool, and may in general, for instance, resemble the tool disclosed in U.S. Pat. No. 3,254,522. Such part of the illustrative tool will not, therefore, be described further herein except to mention that air under pressure from a flexible hose is admitted to the cylinder 14 below a piston (not shown) through a valve actuated by a trigger 20 (FIG. 1), and a piston, not shown, in the cylinder 16, and subjected to hydraulic pressure for a mandrel pulling stroke of the tool, is secured to a pull rod 22, shown in FIG. 4. Release of the trigger 20 reverses the air flow in the cylinder 14, and the pull rod 21 is advanced (i. e. to the left, viewing FIG. 4) by a return spring 24.

Upon a forward end portion of the pull rod 22 is screwed a jaw case 28 (FIG. 4), of conventional construction, with a conical internal wall in engagement with which are part conical outer surfaces of two jaws 30,30'. A jaw pusher 32, urged forwardly by a spring 34 in an axial recess in the pull rod 22, has itself an axial recess 36 at its front end. A sealing buffer 38 behind a front annular wall 39 of the portion 17 of the housing 10 is arranged to be engaged by the jaw case 28 at the forward end of its stroke.

Figure 4:
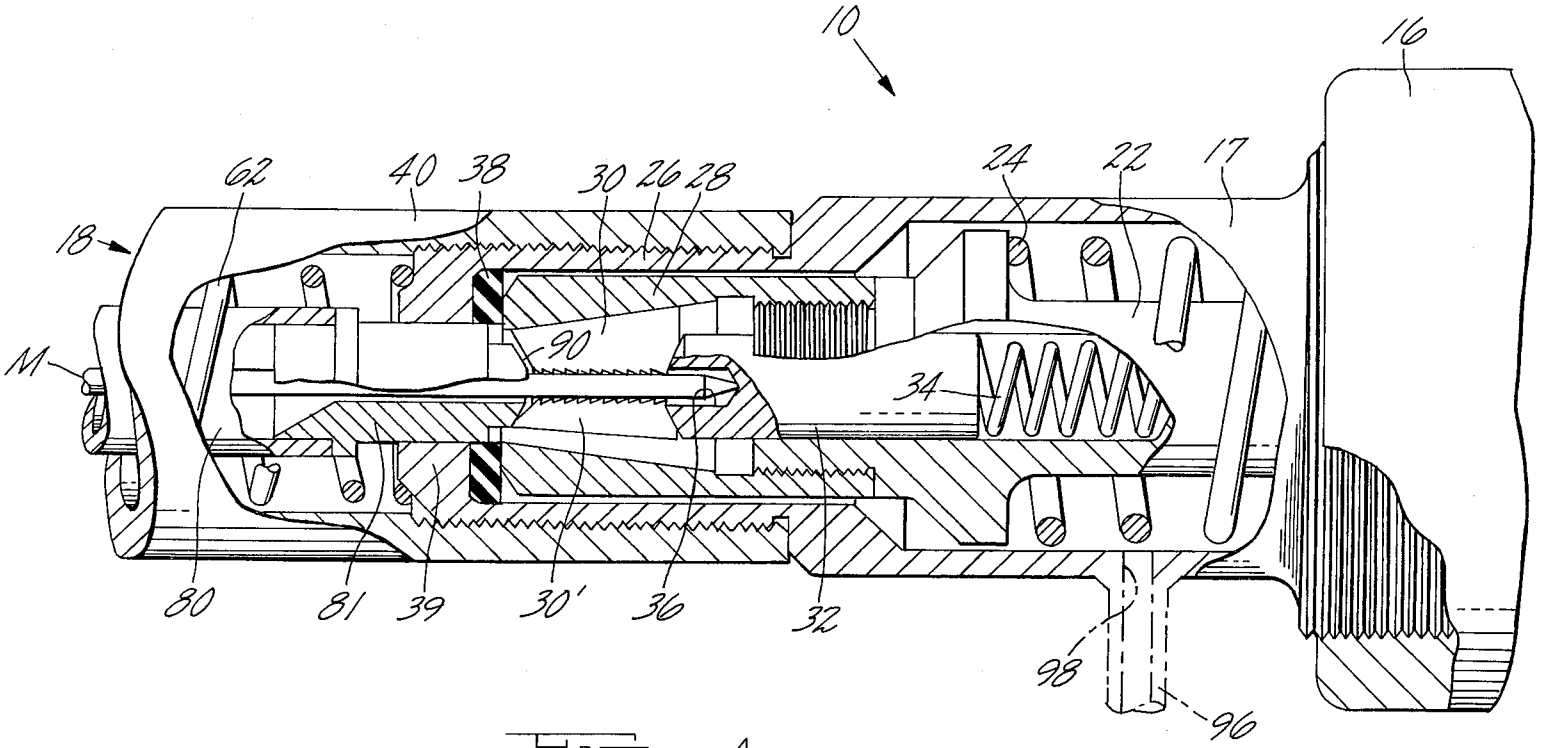
FIG. 4 is a view in side, with parts broken away and partly in section, showing mandrel-engaging means in a rearward barrel portion of the illustrative tool.

Screwed on to a front part of reduced diameter of the portion 17 of the housing 10 is the barrel 18 which is long enough to accommodate a long pull-through mandrel M with, say, 25 rivets R (FIG. 2) on it. A rear end portion of the mandrel M is shown in FIG. 4, where it is seen gripped by the jaws 30,30', its tip abutting the bottom of the recess 36 in the jaw pusher 32. (It is the purpose of the recess 36 to enable the jaw pusher to serve as a stop to position the mandrel correctly lengthwise in the tool when it is initially inserted by the operator.)

Figure 2:
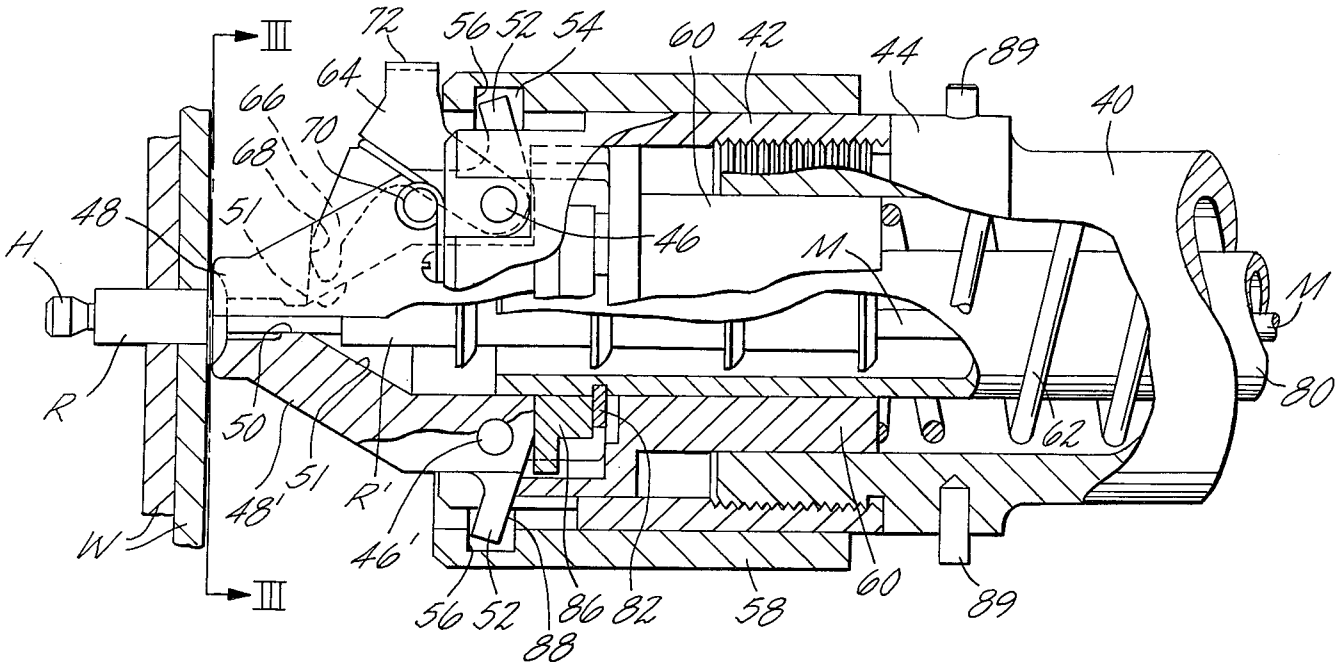
FIG. 2 is a view in side elevation, with parts broken away and partly in section, of a front end portion of the illustrative tool.
Figure 3:
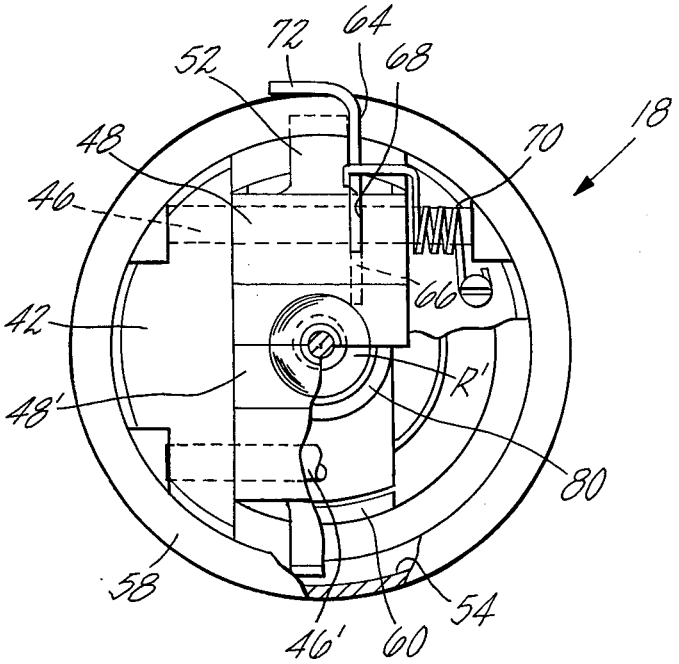
FIG. 3 is a view in section on the line III—III of FIG. 2.

Turning now to FIGS. 2 and 3, the barrel 18 of the illustrative tool can be seen to be in two parts, a cylindrical tube 40 screw-threaded externally at its front end, and an internally threaded cap 42 screwed on to the tube and abutting a flange 44 at the front of the tube 40. Mounted on the cap 42, on two transverse pivot pins 46,46', respectively, are two abutment members 48,48'. The pins 46,46' are parallel and extend widthwise of the tool, which is shown in an upright position in FIG. 1. Thus, one of the abutment members, 48, on the pin 46, is uppermost. The abutment members 48,48' constitute a nosepiece of the illustrative tool, and when in a closed condition, as shown in FIGS. 1, 2 and 3, provide an abutment to engage the head of a rivet R (FIG. 2) in a rivet-setting operation.

The two abutment members 48,48' are similar (except that the one 48 has a slot, as mentioned hereinafter) each having a forwardly extending, narrowing, configuration terminating in a semi-annular end face, which is recessed to accommodate a head H (FIG. 2) of the mandrel M at the end of a rivet-setting stroke. Behind the recess in the end face, each member has a neck 50 for closely embracing the mandrel stem. Behind the neck 50, each member is hollowed out, with inclined surfaces 51, to accommodate the next rivet R' on the mandrel stem.

Each of the abutment members 48,48' of the illustrative tool also has an outwardly projecting arm 52 accommodated in an annular recess 54, behind an internal shoulder 56, of a collar 58, slidably received on the cap 42. Rearward movement of the collar 58 by the operator thus results in opening of the members 48,48'. A flanged sleeve 60 slidably mounted in the cap 42 and in a front portion of the tube 40 bears against the members 48,48' outwardly of the pins 46,46', and, being urged forwardly by a compression spring 62 (which runs the length of the barrel and bears on a front face of the portion 17 of the housing 10, see FIG. 4) resiliently urges the members 48,48' into their closed condition.

Also mounted on the pin 46 is a catch 64 which has a finger 66 (FIG. 3) accommodated in a slot 68 in the upper abutment member 48. A torsion spring 70 urges the catch into an out-of-the-way position, in which it is shown in FIG. 2. The catch 64 has an uppermost flange 72 which enables an operator by means of his thumb to rock it downwardly (i. e. counter-clockwise, viewing FIG. 2) so that the finger 66 engages the side of the head of the rivet R' next behind the leading one R on the mandrel stem, after the leading one has been advanced, as hereinafter described, between the members 48,48', so as to push the rivet R', and the column of rivets behind it, back along the mandrel stem, thereby allowing the members 48,48' to close behind the leading rivet R without interference from the rivet R'. As shown in FIG. 3, the finger 66 is offset from the axis of the barrel 18 of the illustrative tool so that, when rocked downwardly, it comes down at one side of the shank of the rivet R'. In FIG. 2, the rivet R' is seen already having been pushed back by the catch out of the way of the mandrel-engaging neck 50 of the members 48,48'.

As an alternative (not shown) to operating the catch 64 individually by the operator's thumb, the illustrative tool may be modified by extending the recess 54 in the collar 58 further rearwardly sufficiently far to permit the operator to move the collar relatively forwardly, from the position shown in FIG. 2, and thereby operate the catch.

Turning now to FIGS. 2 and 4, running lengthwise in the barrel 18, and co-axial therewith, is a sleeve 80 capable of limited axial movement. The sleeve 80 is supported near its front end by the sleeve 60 and at its rear end has a plug 81 with a hole through it for the mandrel stem, the plug being slidably supported by the annular wall 39 of the portion 17 of the housing 10. Near its front end, FIG. 2, the sleeve 80 has an external annular groove to receive a split ring 82 which lies between a face 84 of the sleeve 60 and a stop piece 86 supported on the sleeve 80 in front of the ring 82. The stop piece 86 bears against rear faces 88 of the abutment members 48,48'. The faces 88 are shaped, see the angled face of the member 48' in FIG. 2, so that when the members are rocked on the pins 46,46' to an open condition just sufficient to allow the passage of rivets therebetween, although the sleeve 60 will be moved back against the influence of the spring 62, the stop piece 86 and consequently the sleeve 80 will not move rearwardly, any tendency to do so being overcome by the spring 34 acting through the jaw pusher 32 and jaws 30,30'. But if the members 48,48' are swung more widely open by the operator pulling back the collar 58, to a limit imposed by pins 89 (FIG. 2) projecting from the flange 44 of the tube 40, the faces 88 acting through the stop piece 86 and ring 82 will move the sleeve 80 rearwardly along the barrel. In such event, the plug 81 in the sleeve 80, which projects into the jaw case 28 and has a part conical rear end face 90, pushes the jaws 30,30' rearward against the action of the spring 34 and thus releases their grip on the mandrel stem.

By so moving the collar 58 rearwardly, the operator thus both opens the abutment members 48,48' and releases the mandrel, enabling it to be removed and replaced. The mandrel (or a fresh one) thus inserted until its tip touches the bottom of the recess 36 in the pusher 32 is gripped by the jaws, under the influence of the spring 34, upon release of the collar 58 by the operator.

Means for advancing the rivets along the mandrel stem between rivet-setting operations of the illustrative tool will now be described. The pneumatic cylinder 14 is double acting, air being admitted to the cylinder above the piston therein on release of the trigger 20. From the top of the cylinder, a pipe 92 (FIG. 1) leads to a valve 94, from which a further pipe 96 leads to an inlet port 98 (FIG. 4) at one side of the portion of the housing through which the pull rod 22 passes. When the trigger 22 is pressed, an arm 100 (FIG. 1) on the side of the trigger actuates the valve 94 to exhaust air from above the piston in the cylinder 14 through the pipe 92 to atmosphere. When the trigger is released, the valve directs air under pressure from the cylinder 14 to the port 98 (as well as to the cylinder 14)whence it flows between the jaw case 28 and the portion 17 of the housing 10 and round the mandrel stem into the sleeve 80. It flows forwardly along the sleeve and out of the tool at the front of the barrel. The effect of such flow is to advance the column of rivets along the mandrel stem, the leading one being forced between the abutment members 48,48' which are opened by the leading rivet acting on the inclined surfaces 51, the spring 62 yielding to allow the members to open. The flow of air is terminated when the jaw case 28, which starts to move forward when the trigger is released, engages the buffer 38 and thus seals off the gap between the jaw case and the portion 17 of the housing 10.

In using the illustrative tool, the operator loads the tool with a mandrel on which there is a column of rivets to be successively installed. All he has to do to remove an empty mandrel from the tool and insert a fresh one (or the same one with fresh rivets on it) is to retract the collar 58, which both opens the abutment members 48,48' and releases the grip of the jaws 30,30' on the mandrel stem, and draw the mandrel out. After inserting the fresh mandrel until he feels the resistance of the pusher 32, he releases the collar, whereupon the sleeve 60, under the influence of the spring 62, closes the members 48,48' and moves the sleeve 80 forwardly so that the jaws grip the mandrel stem. He will, if necessary, use the catch 64 to clear the rivets from interfering with the closing of the members 48,48' and if the leading rivet is not in front of the members 48,48', he will press and release the trigger 20 to cause the tool to perform an operating cycle to put it there, and depress the catch 64 so that the members 48,48' can close properly.

The rivets on the mandrel in using the illustrative tool will preferably have heads only slightly smaller than the internal diameter of the sleeve 80, to take full advantage of the short blast of air along the sleeve as the mandrel comes forward after a rivet-setting stroke. But should the rivet heads be so small that insufficient force is generated to push the leading rivet through the abutment members 48,48', a rivet with a larger head, or a separate plunger, may be placed on the mandrel at the end of the column of rivets.

The length of the mandrel used in the illustrative tool is desirably such that at the end of the rivet-setting stroke its head is fully received in the recessed front face of the nosepiece constituted by the members 48,48'.

With the illustrative tool in its ready-to-operate condition with the leading rivet ahead of the abutment members 48,48', the operator manipulates the tool to insert the rivet shank in a hole in a workpiece W (FIG. 2), and holding the rivet against bodily movement relative to the workpiece by pressing the nosepiece of the tool against the rivet head, he squeezes the trigger 20. The mandrel M executes a rivet-setting stroke in which its head H is pulled right through the rivet and into the recess in the face of the nosepiece. Upon release of the trigger, air is blown forwardly along the sleeve to advance the column of rivets on the mandrel stem and to push the leading one past the abutment members 48,48'. As the mandrel reaches its foremost position, the jaw case 28 engages the buffer 38 and the flow of air along the sleeve 80 ceases. The members 48,48' will have partially closed, under the action of the spring-loaded sleeve 60, on to the shank of the rivet next to the leading one. The operator now flicks the catch 64 with his thumb to push the column of rivets back along the mandrel stem and allow the members 48,48' to close properly. The illustrative tool is now ready for another rivet-setting operation.

The illustrative tool is reliable and rapid in operation, and replenishment of a spent mandrel can readily be effected.

Having thus described my invention, what I claim as new and desire to secure by Letters Patent of the United States is:

1. A blind riveting tool of the type including a reusable mandrel carrying a plurality of rivets to be successively set thereby, the tool comprising an elongated barrel, abutment members movably mounted on the barrel and closeable to engage a rivet head during rivet setting, means engageable with the stem of the mandrel to pull it in the setting operation, means for advancing the rivets along a stem of the mandrel to position the leading rivet beyond the abutment members, and means for urging the next to leading rivet and those behind it rearwardly so that the abutment members can close to embrace the mandrel behind the leading rivet without interference from the next one.

2. A tool as in claim 1 wherein the tool comprises a housing including said barrel, said abutment members are movably mounted on the front portion of the housing and closeable for engaging the rear side of the head of said leading rivet during rivet setting, and means for engaging a front side of the head of the rivet on the mandrel next to the leading rivet and pushing said next rivet and those behind it rearwardly to avoid interference with the abutment members, and mechanism movably mounted on the housing for opening said members from their closed condition to allow advance therebetween of the rivets and to release the mandrel stem whereby it may be removed for reloading of the tool.

3. A tool as in claim 2 wherein the means for moving said next and following rivets rearwardly is a catch yieldingly rockable on a pivot extending widthwise of the tool, said catch being accommodated in a slot in one of said members and offset at least in part from the axis of said barrel.

4. A tool as in claim 2, and a sleeve surrounding the rivets on the mandrel in said barrel, and means for causing air to flow through the sleeve to advance the rivets on the mandrel stem so that the leading one of said rivets can advance forwardly beyond the abutment members.

5. A tool as in claim 4, further comprising a spring-pressed jaw pusher, said mandrel engaging means including cooperative gripping jaws slidable along inclined paths within a jaw case and urged by the pusher into mandrel engagement, said sleeve being axially movable within the barrel and arranged, during rearward movement, to separate the jaws from mandrel engagement.

6. A tool as in claim 4 having a manually operable member slidable on the housing and operatively connected to the sleeve for moving said sleeve into mandrel releasing position.

7. A blind riveting tool comprising a housing which includes an elongated barrel, abutment members mounted on a front end portion of the barrel for movement between closed and open conditions and engageable in closed condition with a rivet head in a rivet-setting operation, a mandrel with a stem adapted to carry a plurality of rivets thereon, means for engaging the mandrel stem to pull it in a rivet-setting operation, a sleeve extending axially in the barrel and surrounding the rivets on the stem, and means for causing air to flow through the sleeve to advance the rivets along the stem to urge a leading one of the rivets beyond the abutment members.

8. A tool as in claim 7 wherein the mandrel engaging means comprises a plurality of gripping jaws arranged in a jaw case for sliding movement along paths inclined at a small angle to the axis of the barrel, a spring-pressed pusher for urging the jaws into engagement with the mandrel stem, means mounting said sleeve for axial movement in the barrel, the sleeve being disposed during rearward movement to engage the jaws and separate them as they are thus caused to retract relative to the jaw case, and a member mounted on the housing and operable manually to move the sleeve rearwardly to effect release of the mandrel from said jaws.

* * * * *